US008011939B2

(12) United States Patent
Braem et al.

(10) Patent No.: US 8,011,939 B2
(45) Date of Patent: Sep. 6, 2011

(54) COAXIAL CONNECTOR

(75) Inventors: Yves Braem, Gent (BE); Lieven Decrock, Roeselare (BE); Johannes Mariunus Den Otter, Rosmalen (NL); Patrick Marcel Duquerroy, Seligenstadt-Froschhausen (DE); Dennis Halberstadt, Rosmalen (NL); Jacobus Nicolaas Tuin, Best (NL)

(73) Assignees: Tyco Electronics AMP GmbH, Bensheim (DE); Tyco Electronics Nederland BV, AR's-Hertogenbosch (NL); Tyco Electronics Belgium EC NV, Oostkamp (BE)

( * ) Notice: Subject to any disclaimer, the term of this patent is extended or adjusted under 35 U.S.C. 154(b) by 0 days.

(21) Appl. No.: 12/736,080

(22) PCT Filed: Mar. 3, 2009

(86) PCT No.: PCT/EP2009/052491

§ 371 (c)(1),
(2), (4) Date: Nov. 30, 2010

(87) PCT Pub. No.: WO2009/112396

PCT Pub. Date: Sep. 17, 2009

(65) Prior Publication Data

US 2011/0076869 A1 Mar. 31, 2011

(30) Foreign Application Priority Data

Mar. 10, 2008 (EP) ..... 08004517

(51) Int. Cl.
*H01R 18/32* (2006.01)

(52) U.S. Cl. ..... 439/188

(58) Field of Classification Search ..... 439/668, 439/79, 947, 108, 188, 339
See application file for complete search history.

(56) References Cited

U.S. PATENT DOCUMENTS 6,068,499 A * 5/2000 Kuriyama et al. ..... 439/188
(Continued)

FOREIGN PATENT DOCUMENTS

EP 1 039 588 A 9/2000
(Continued)

OTHER PUBLICATIONS

International Search Report for PCT/EP2009/052491 issued by the European Patent Office on May 7, 2009.

*Primary Examiner* — T C Patel
*Assistant Examiner* — Phuongchi T Nguyen
(74) *Attorney, Agent, or Firm* — Baker & Daniels LLP

(57) ABSTRACT

The invention relates to a coaxial connector (1) for mounting on a printed circuit board adapted to receive a mating coaxial connector in an insertion direction (I). The coaxial connector comprises a contact spring (8) having a fixed leg (16) and an deflectable switching leg (15). The switching leg (15) is moved by insertion of the mating connector from a rest position to a switching position. In rest position said switching leg electrically conductively presses against the switch portion (19) of the contact element (10). The spring force flux (F) is guided via a contact element (10) in a closed loop back to the contact spring (8). In switching position the switching leg (15) is spaced apart in an switching direction (D) from the switch portion (19) by the inserted mating connector. To provide smaller dimensions the contact element (10) is formed as a substantially C-shaped clip forming an opening (O) framed by the support portion (20) and the switch portion (19), the switching leg (15) of the contact spring (8) extending into the opening.

16 Claims, 3 Drawing Sheets

U.S. PATENT DOCUMENTS

| | | | | |
|---|---|---|---|---|
| 6,393,698 | B1 | 5/2002 | Kuriyama | |
| 6,439,906 | B1 * | 8/2002 | Gray et al. | 439/188 |
| 7,217,137 | B1 * | 5/2007 | Nakagawa | 439/63 |
| 2004/0175978 | A1 | 9/2004 | Mugiuda et al. | |
| 2006/0128195 | A1 | 6/2006 | Chen | |

FOREIGN PATENT DOCUMENTS

| | | | |
|---|---|---|---|
| EP | 1 788 669 | A | 5/2007 |

* cited by examiner

COAXIAL CONNECTOR

The invention relates to a coaxial connector for mounting on a printed circuit board adapted to receive a mating coaxial connector in an insertion direction, the coaxial connector comprising a contact element, said contact element having a terminal portion that is situated accessibly from the outside of the coaxial connector, a support portion and a switch portion, a contact spring being adapted to generate a spring force having a fixed leg and an elastically deflectable switching leg, said contact spring being electrically connected to a spring terminal that is situated accessibly from the outside of the coaxial connector, said switching leg being adapted to be moved by insertion of the mating connector from a rest position, in which said switching leg elastically and electrically conductively presses against the switch portion of the contact element and the spring force flux is guided from said switching leg via the contact element in a closed loop back to the contact spring to a switching position, in which the switching leg is spaced apart in an switching direction from the switch portion by the inserted mating connector.

Coaxial connectors are well known for connecting coaxial cables to electrical equipment. Coaxial connectors having a switching function are, for example, used in mobile phones, in wireless LAN devices, in radio systems and in remote measuring equipment to provide the possibility to connect an external antenna. If the external antenna is connected, the internal antenna of the device is disconnected by the switching function.

Coaxial connectors having a switching function are also known for connection of test probes to a printed circuit board for testing parts of said printed circuit board.

The U.S. Pat. No. 5,625,177 discloses a coaxial connector which is mounted on a printed circuit board. The connector comprises a mating portion corresponding to a second coaxial connector, having an inner conductor and an outer conductor separated from the inner conductor by a dielectric. The connector has a movable switching leg, arranged under the insertion opening and electrically connected to a printed circuit board. The switching leg abuts to a second circuit portion electrically connected to a second portion of the printed circuit board. When a plug-in contact is inserted into the insertion opening the spring arm is deflected and thereby the contact between the spring arm and the second contact portion is separated. At the same time an electrical contact between the plug-in connector and the spring arm is closed.

GB 2307113 A describes a coaxial connector for connecting an external antenna to a mobile telephone. The connector comprises a housing having an insertion opening adapted to receive a mating coaxial connector in an insertion direction and a switch having first and second contacts with portions for connection to a printed circuit board. A switching leg extends between the first and second contacts, the switching leg being biased into a position in which it connects the two contacts electrically. A pressure applied by a plug-in conductor to the contact portion of the switching leg deflects the switching leg elastically so as to disconnect the electrical contact.

Also the WO 98/31078 A describes a coaxial connector assembly for connecting an external antenna to a mobile phone. A coaxial connector is mounted on a printed circuit board within a device such as a portable phone. The connector comprises a contact spring having one spring leg extending from a form fit in the housing through the insertion path of the center pin to a contact leg. In unmated state the contact spring is contacted at its contact projection with the contact leg. When a counter connector is mated to the coaxial connector, the plug-in contact abuts against the center pin to push the same downward. As a result, the center pin is moved downward against the bias of the contact spring, so that the connection from the contact spring to a contact leg is interrupted. The signal from the contact spring of the coaxial connector is fed through the central conductor via the center pin.

Furthermore, GB 2351617 A describes a similar coaxial connector wherein a central pin interacts with the resilient leg of a contact spring to operate as a switch, when the connector is in use.

From the EP 1039588 A2 a switch for mounting on a printed circuit board is known, wherein the inner contact of the coaxial connector is formed by a biased spring leg. When a plug-in contact is inserted into an insertion opening, the spring leg is moved in mating direction that the electrical contact between the end portion of the spring leg and the contact on the printed circuit board is disconnected.

The EP 1278274 B1 describes a coaxial connector assembly for use in a mobile phone. The coaxial connector assembly is arranged in a housing of a mobile phone. A first coaxial connector is mounted on a printed circuit board of the mobile phone and comprises a contact spring which is fixed to the first connector. The contact spring forms an inner contact of the first coaxial connector and protrudes with a u-shaped portion as a tip from a mating face. The inner contact of the contact spring is movable in an axial direction, to provide a switching function between a signal from the second connector or the internal antenna. Upon mating of the first and second coaxial connector the inner contact of contact spring is pushed down so as to separate its contact portion from the counter contact portion.

The design of the springs of these known types of connectors necessitate large housings if a suitable deflection of the spring is to be obtained.

A microswitch connector for use in a mobile phone to connect an external antenna is known from WO 2004/077626 A1. The housing of the connector has a contact chamber which is accessible at its upper end via an insertion opening for the insertion of a plug-in contact. A contact spring positioned in the contact chamber has a fixed leg and a switching leg which are mutually connected via a spring bend. If the plug-in contact is not mated to the connector the free end of the switching leg rests against a stop of the housing. The stop belongs to a housing region with a metallic coated surface, thus resulting in electrical contact between the switching leg and the stop. The stop is connected electrically with a contact face of the housing provided for making contact with the conductor of the printed circuit board. If a plug-in contact of a mating connector is inserted into the contact chamber, the plug-in contact will move the switching leg in a direction perpendicular to the insertion direction and raise the free end of the switching leg from the electrically conductive stop. Thereby the electrical connection between the contact spring and the contact face of the housing is broken. Simultaneously, an electrical connection is made between the electrical component connected to end of the fixed leg and a further electrical component connected to the plug-in contact.

The connector of WO 2004/077626 A1 is too large for many applications.

The invention strives to provide smaller connectors.

This object is achieved by a substantially C-shaped embodiment of the contact element, wherein the contact element is formed as a clip forming an opening framed by the support portion and the switch portion, the switching leg of the contact spring extending into the opening. With this C-shaped contact element the spring force flux outside the contact spring is shortened. This allows for withdrawal from a housing supporting the contact spring and conducting the force flux respectively and thereby for making the coaxial connector smaller.

In a further advantageous embodiment the switching direction is arranged parallel to the insertion direction. This solution allows for arranging the switching leg of the contact spring perpendicular to the insertion direction and thereby enables a flat geometry of the coaxial connector. By using the longest distance within the given outline of the connector on the printed circuit board, it is possible to design a spring with sufficient stroke for an appropriate opening of the contact when switched off and providing sufficient contact force for a reliable contact when switched on.

In the state of the art the spring that generates the contact force for the switch, is typically encapsulated in a housing. Usually the housing provides support for the contact force, i.e. guides the force flux generated by the spring back to the spring via the clamping or fixation of the spring base in the housing. If the housing is formed from plastic it tends to weaken when the connector is soldered in a reflow oven. This weakening of the housing may jeopardize the contact force, as the contact, under the load of the contact force, will move into the subjacent face of the housing.

The coaxial connector preferably comprises a contact element, which is integrally formed as a single body. The contact element can be arranged at the opposing ends of the spring legs to shorten the spring force flux. By guiding the spring force flux in a closed loop within a separate part, which is insensitive against heat, the contact force cannot be weakened by a relaxation of the housing. By guiding the contact force generated by the spring directly, in line with the line of application of the contact force, to the fixed portion of the contact spring, no forces or torsion moments are applied on the housing.

In order to decouple the force flux from the circumjacent housing the contact element may be formed from material having a higher modulus of elasticity than the material of the housing. If the housing is formed from plastic the contact element can, for example, be formed from metal.

For locking a mated counter connector the housing of the coaxial connector may have at least one ledge catch for holding a complementary ledge of the mating connector. This ledge catch may be a recess at the bottom side of the coaxial connector to provide a simple geometry, appropriate to the small dimensions of the device.

In a further advantageous embodiment, the ground conductor, which is typically an integrated part of a coaxial connector may be left out. Instead of integrating additional parts into the coaxial connector the ground contact for connecting the ground conductor of a mated counter connector may be provided on the printed circuit board adjacent to the mounted coaxial connector. Advantages of this solution are reduced costs, a simplified assembly process, and the possibility to enlarge the distance between the ground contact and the signal contact.

If an outline or outer contour is prescribed for mounting the connector on the printed circuit board, the outline of the mounting base of the connector can be adapted to said outline on the printed circuit board. By offering recesses in the coaxial connector, extending from the upper side of the coaxial connector in mating direction up to the surface of the printed circuit board, a ground contact of a counter connector may be guided directly onto the ground layer of the printed circuit board. This embodiment enables to further scale down the coaxial connector. For connecting electrically the ground conductor of the counter connector to the ground contact on the printed circuit board, the counter connector may comprise spring loaded pins that are pressed onto the ground layer while the counter connector is mated to the connector.

In a further embodiment of the invention the coaxial connector comprises a ground conductor positioned at the upper side of the coaxial connector, next to the insertion opening of the coaxial connector. This ground conductor may be formed, for example, from a stamped sheet metal strip comprising a preferably circular hole. Said hole matches the outline of the insertion opening. For fixing the ground conductor by a form fit or positive locking, the sheet metal representing the ground conductor may comprise metal straps which are bent around the lateral sides of the housing. The metal straps can provide a form fit to the housing by embracing the housing from above along the lateral sides of the housing. By bending end portions of said metal straps into recesses within the mounting base of the housing the form fit can be closed.

For locking the counter connector the latches of the ground conductor can have cut-outs, providing ledge catches for catching ledges belonging to the counter connector.

The invention is described hereafter by way of example using two embodiments with reference to the drawings. The different characteristics of the two embodiments and the advantages to be achieved through them can be combined with each other at will in the process or left out, as emerges from the above embodiments. In the drawings.

Figure 1:
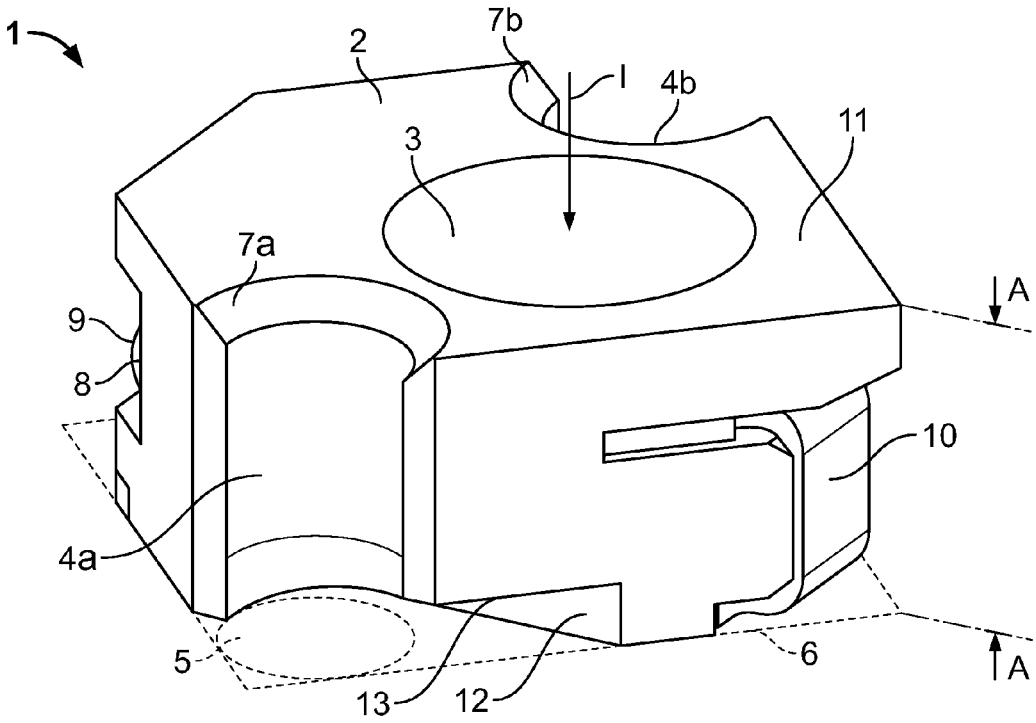
FIG. 1 shows a highly enlarged perspective view of a first embodiment of the coaxial connector.

FIG. 1 shows a perspective view from above of a coaxial connector according to an exemplary embodiment of the invention. The coaxial connector 1 comprises a housing 2 which is substantially cubic in shape. At the top of the housing 2 an insertion opening 3 for the insertion of a not shown plug-in contact in insertion direction I is provided. The housing has two diagonally opposing semicircular recesses 4*a*, 4*b* at opposite edges to leave open circular surfaces 5 on the not shown sub-adjacent printed circuit board within the given outline 6 for mounting the coaxial connector 1. The outline 6 determines the admissible outer contour of the coaxial connector 1 as the contour may be able to be inscribed as a whole within the outline 6. The vertical edges of the semicircular recesses 4*a*, 4*b* and the semicircular edges 7*a*, 7*b* bordering the semicircular recesses on the top of the housing are chamfered. The contact spring 8 is oriented along the diagonal of the rectangular outline 6, perpendicular to the diagonal connecting the semicircular recesses 4*a*, 4*b*.

The spring further at preferably one end in longitudinal direction a bent portion, termed spring bend 9 in the following. Opposing the spring bend 9 a contact element 10 is inserted into the housing 2, guiding the spring force flux F generated by the contact spring 8 in a closed loop back to the contact spring 8. The outer surface of the back portion 21 of the contact element 10 is arranged perpendicular to the mating face 11 and to the diagonal of the housing 2 which runs from the contact element 10 to the spring bend 9. The outer surface of the back portion 21 is integral part of the outer surface of the coaxial connector 1. On the opposite end of the diagonal, where the spring bend is positioned, the vertical edge of the housing 2 is chamfered.

The upper surface on the housing of the coaxial connector 1 which extends transverse to the insertion direction I serves as mating face 11. At the bottom side of the coaxial connector 1, opposing the subjacent printed circuit board (not shown) and in the area of the semicircular recesses 4*a*, 4*b*, the housing has recesses 12, extending parallel to the mating face 11. These recesses 12 provide edges 13 which run parallel to the upper side of the housing 2, vertical to the insertion direction I.

Figure 2:
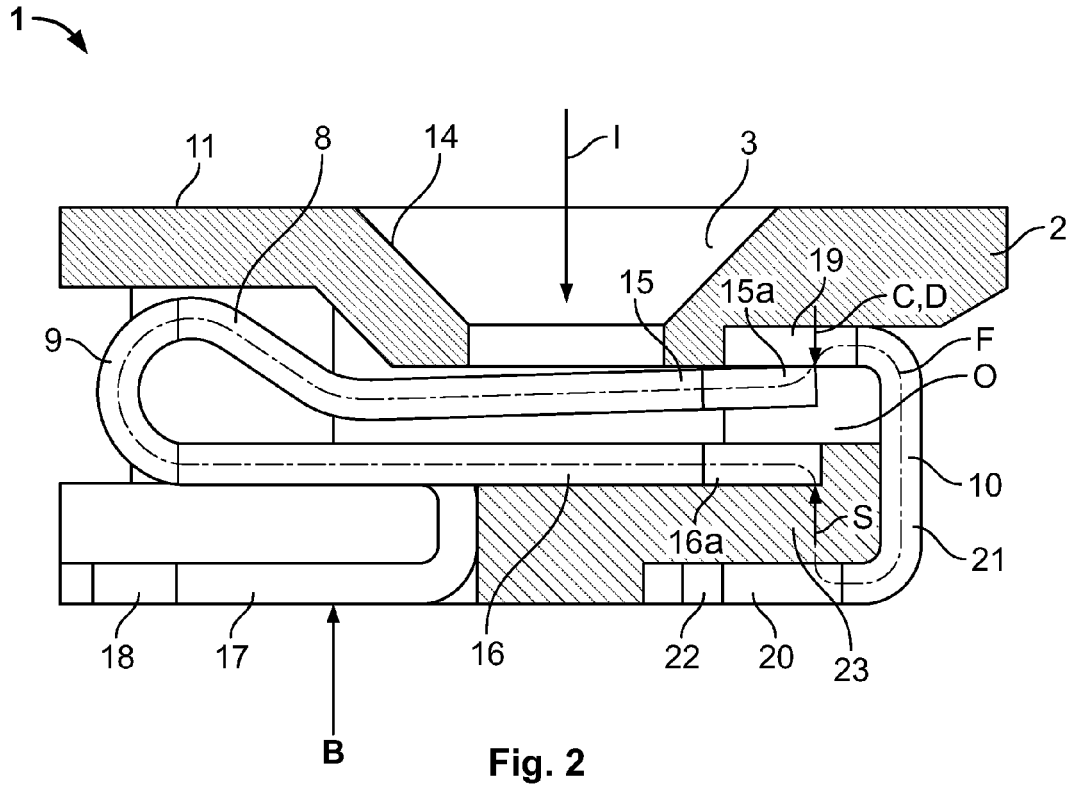
FIG. 2 shows a highly enlarged cross sectional view of the first embodiment of the present invention along the section A-A of FIG. 1.

FIG. 2 is a cross sectional view of the first embodiment of the present invention along the section A-A of FIG. 1. It illustrates the arrangement of the contact spring 8 and the contact element 10 in the housing 2 of the coaxial connector 1.

The insertion opening 3 for the insertion of a not shown plug-in contact may be chamfered to form a funnel 14 which facilitates the insertion of the plug-in contact. Under the insertion opening 3 the contact spring 8 extends from a first edge of the housing 2, where the spring bend 9 is positioned, diagonal to a second edge of the housing, where the connector element 10 is arranged. The spring bend 9 couples a switching leg 15 to the fixed leg 16. At the end of the switching leg 15 the contact spring 8 has a contact section 15*a* and at the end of the fixed leg 16 the contact spring 8 has a support section 16*a*. In addition the contact spring 8 comprises a terminal leg 17 extending from a middle portion of the fixed leg 16 in the direction to the spring bend 9. The terminal leg 17 is preferably integral with a spring terminal 18 that is accessible from outside at the mounting base B. The switching leg 15 of the contact spring 8 abuts against the insertion opening 3. The contact spring 8 may be formed from a conductive material, for example, electrically conductive metal, and preferably stamped in one piece out of a metal sheet.

The contact element 10 has a switch portion 19 and an opposing support portion 20, connected by a back portion 21. Adjacent to the support portion 20 the contact element comprises a terminal portion 22. The contact element 10 is preferably mounted by pushing the contact element 10 into the housing 2 along the diagonal of the housing which runs from the back portion of the contact element 10 to the spring bend 9. Also the contact spring 8 may be mounted by pushing the contact spring 8 into the housing along said diagonal.

The switching leg 15 and the fixed leg 16 of the contact spring 8 both cross the insertion axis I and extend into the opening O of the contact element 10 that is framed by the switch portion 19 and the support portion 20. The contact section 15*a* of the biased switching leg 15 abuts against the switch portion 19 of the contact element 10; the support section 16*a* of the fixed leg 16 abuts against the support portion 20 of the contact element 10. The contact section 15*a* exerts a contact force C onto the switch portion 19 of the contact element 10. Opposing the spring bend 9 the contact element 10 guides the force flux F coming from the switching leg 15 through the switch portion 19 to the support portion 20 from where the force flux F crosses the insulating material 23 and attains in a closed loop the support section 16*a* of the fixed leg. At the support section 16*a* from the force flux F results the support force S. The contact force C and the support force S are aligned with each other so that no moments of torsion arise. The insulating material 23 is integrated part of the housing 2 and holds the contact element 10 by a form closure in its position.

If a plug-in contact that constitutes a portion of a counter connector is inserted into the insertion opening 3 the switching leg 15, which is arranged adjacent to the insertion opening 3, is resiliently depressed by the plug-in contact by depressing the switching leg 15, the switching leg 15 and at least a portion of the fixed leg 16 is deflected. By moving the switching leg 15 in insertion direction I the electrical contact between the contact section 15*a* of the switching leg 15 and the switch portion 19 of the contact element 10 is broken. The switching leg 15 is arranged transversal to the insertion direction I, so that the switching direction D, i.e. the moving direction of the contact section 15*a* of the switching leg, is parallel to the insertion direction I.

The switching leg 15 can be moved up to a mating position wherein a mating face of the counter connector abuts against the mating face 11. Alternatively the switching leg 15 may be moved substantially in insertion direction I until it abuts against the fixed leg 16. In mating position, the plug-in contact is electrically connected to the contact spring which is electrically conductive. Thereby plug-in contact is through the spring terminal 18 connected to the printed circuit board.

Figure 3:
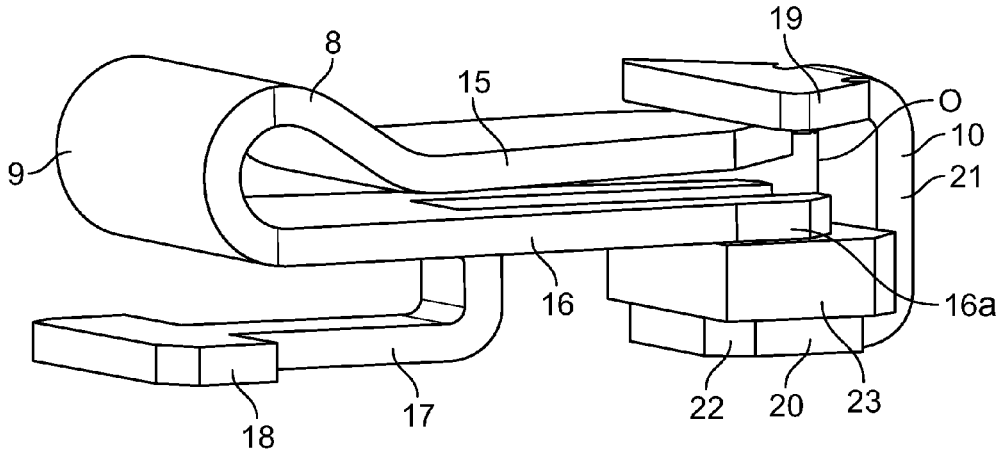
FIG. 3 shows part of a coaxial connector according to a first embodiment according to the invention in a schematic perspective view.

FIG. 3 shows a perspective view from above of the contact spring 8 according to an exemplary embodiment of the invention. The spring terminal 18 as an integrated part of the contact spring 8 may be cut out from the portion of a metal strip which later forms the fixed leg 16. The metal strip is cut out beginning from the support section 16*a* of the fixed spring leg 16 in the direction of the spring bend 9. To create an accessible spring terminal for mounting on a printed circuit board the terminal leg 17 is bent downwards extending to the mounting level of the coaxial connector 1 and from there to an angle of approximately 90° substantially in the direction of the spring bend 9. The terminal leg 17 extends parallel to the fixed leg 16 to a position lying under the spring bend 9. At the end of the terminal leg 17 the metal strip is formed to an approximately rectangular shape to provide the spring terminal 18 which is fixed at the printed circuit board, for instance, by soldering.

The spring bend 9 consists of a semicircular portion of the metal strip and connects the fixed leg 16 to the switching leg 15. The switching leg 15, starting from the spring bend 9 runs in a steep angle in the direction of the fixed leg 16 up to approximately a third of its length and from there with a flat angle upwards in the direction of the switch portion 19 of the contact element 10. As well as the support section 16*a* of the fixed spring leg 16 the contact section 15*a* of the switching leg 15 is arranged between the switch portion 19 and the terminal portion 20 of the contact element 10. The elastically deflected switching leg 15 presses against the switch portion 19 and causes an electrically conductive contact between the contact spring 8 and the contact element 10. The fixed leg 16 is arranged on a portion of electrically insulating insulation material 23 which conducts the force flux coming from the switch portion of the contact element 10 to the fixed leg 16. By the electrically conductive contact element 10 the switching leg 15 is electrically conductive connected to the terminal portion 22 of the contact element.

The contact element 10 can be formed from one piece of material, for example, electrically conductive sheet metal. Both ends are bent to approximately 90° to a C-shaped form having two spaced-apart opposing faces that are parallel. The upper face of the contact element 10 forms the switch portion 19, the lower face of the contact element 10 forms the support portion 20. The switch portion 19 and the support portion 20 are connected by a preferably straight and vertical back portion 21. Beginning from the back portion 21 of the contact element 10, which connects conductively the terminal portion 22 with the switch portion 19, the switch portion 19 extends parallel to the fixed leg 16 in the direction of the spring bend 9. Starting from the back portion 21 of the contact element 10 the switch portion 19 widens to an angle of approximately 90°.

Figure 4:
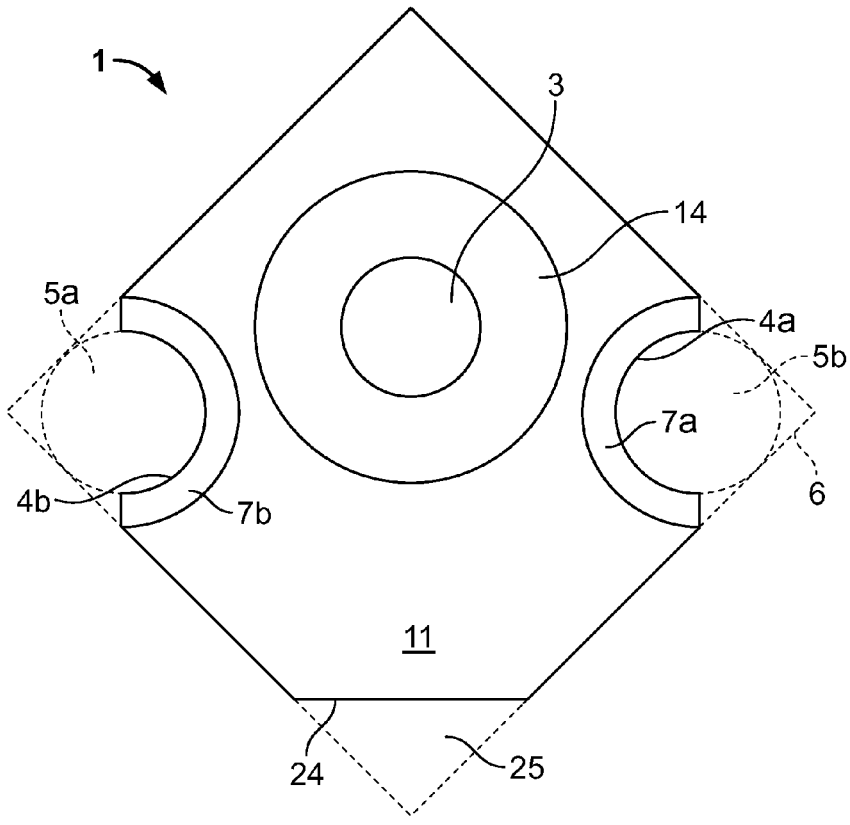
FIG. 4 shows a highly enlarged top view of a first embodiment of the coaxial connector.

FIG. 4 shows a top view of the coaxial connector 1. A rectangular outline 6 on the printed circuit board is given for mounting the coaxial connector 1. The outline of the coaxial connector 1 may be adapted to lie within this outline 6. The edge of the housing 2, where the spring bend 9 is arranged, is chamfered. Under the chamfered edge 24 of the housing 1*a* triangular face 25 is left on the printed circuit board. The semicircular recesses 4*a*, 4*b* border approximately circular surfaces 5*a*, 5*b* on the printed circuit board.

Figure 5:
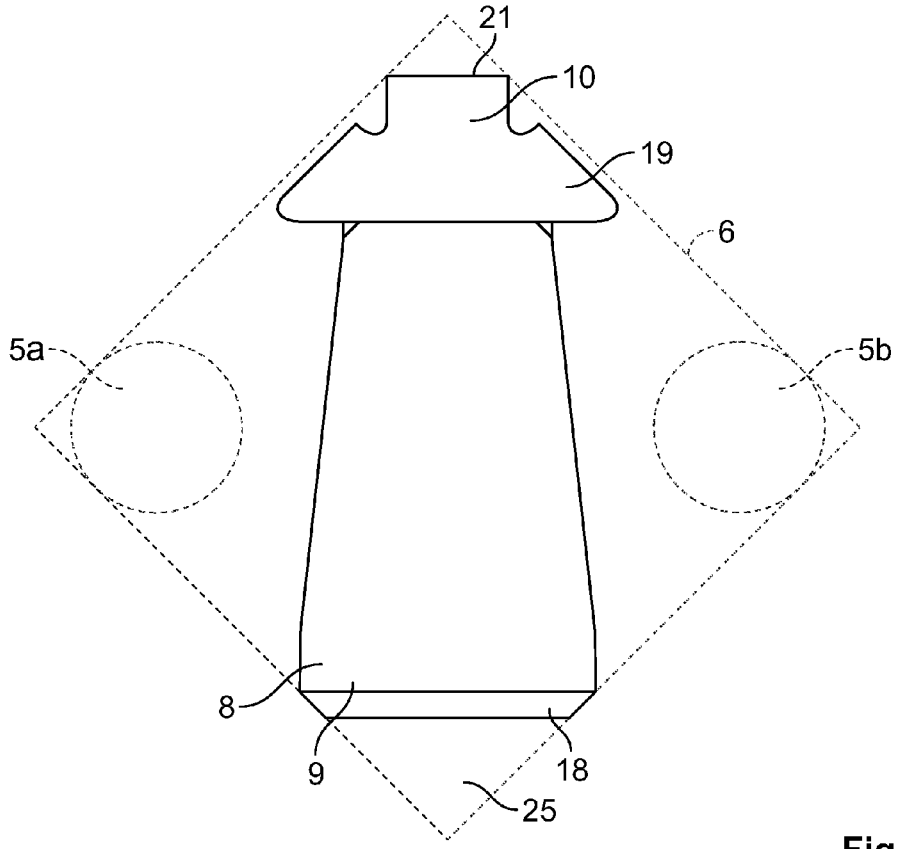
FIG. 5 shows a highly enlarged top view of part of a first embodiment of the coaxial connector.

FIG. 5 shows the position of the contact spring 7 and the contact element 10 within the given rectangular outline 6 on the printed circuit board. The spring legs 15, 16 are oriented along the diagonal of the rectangular outline 6. This corresponds to a maximized length of the contact spring 8 within the outline 6. The edges of the spring terminal 18 which are substantially perpendicular to the printed circuit board are chamfered, so that the outline of the spring terminal 18 is in a perpendicular view aligned to the rectangular outline 6. The back portion of the contact element 10 is arranged perpendicular to the diagonal of the outline 6 which connects the back portion 21 of the contact element 10 and the spring bend 9. The terminal portion 19 of the contact element 10 widens in the direction of the spring bend 9 so that the side faces of said terminal portion 19 each extend parallel to the sides of the rectangular outline 6 on the printed circuit board.

Figure 6:
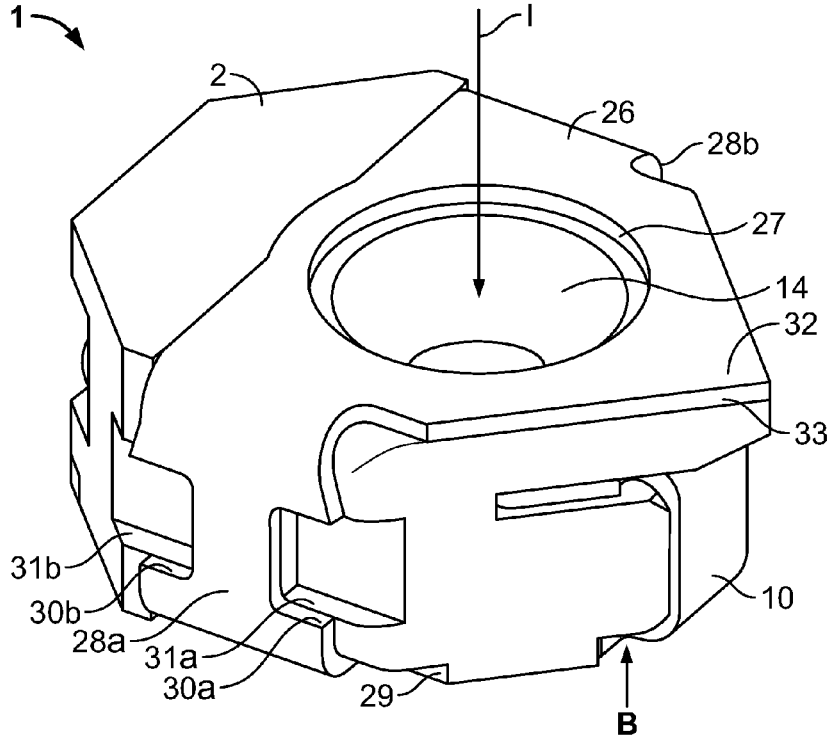
FIG. 6 shows a highly enlarged perspective view of the second embodiment of the coaxial connector.

Another embodiment of the coaxial connector 1 with a ground conductor 26 is shown in FIG. 6. For the sake of brevity, only the differences to the embodiment in FIG. 1 will be considered. The reference numerals FIGS. 1-5 will also be used as far as they relate to elements in FIG. 6 with identical function.

The coaxial connector 1 comprises a ground conductor 26 formed from one piece of sheet metal. The ground conductor has an aperture 27 with a diameter larger than the outer diameter of the funnel 14, mounted coaxial to the funnel 14. The ground conductor 26 embraces the housing 2 by two stripe portions 28*a*, 28*b* which are bent to an angle of approximately 90°, extending in insertion direction I and each encompassing the housing 2 at recesses 29 adjacent to the mounting base B of the coaxial connector 1. The stripe portions 28*a*, 28*b* comprise cut-outs 30*a*, 30*b* whose outline is aligned with the corresponding recesses 31*a*, 31*b* in the housing 2. Thereby the coaxial connector 1 provides cavities that can serve as catches to hold ledges which are part of a counter connector. On the flat top of the coaxial connector the triangular portion 32 of the ground conductor 26 which extends in the direction of the contact element 10 covers the top face of the coaxial connector 1 up to the edge of the housing 2. There the small lateral surface 33 of the ground conductor 26 is aligned with the vertical, lateral side of the housing 2.

The invention claimed is:

1. Coaxial connector for mounting on a printed circuit board adapted to receive a mating coaxial connector in an insertion direction, the coaxial connector comprising:

a contact element having a support portion and a switch portion, the contact element is formed as a substantially C-shaped clip forming an opening framed by the support portion and the switch portion, and a contact spring being adapted to generate a spring force and having a fixed leg and an elastically deflectable switching leg, the switching leg of the contact spring extending into the opening;

the contact spring further comprise a terminal leg extending from a middle portion of the fixed leg in the perpendicular direction to a spring bend for mounting on a circuit board; wherein said switching leg is adapted to be moved by insertion of the mating connector from a rest position, in which said switching leg elastically and electrically conductively presses against the switch portion of the contact element and the spring force flux is guided from said switching leg via the contact element in a closed loop back to the contact spring to a switching position, in which the switching leg is spaced apart in a switching direction from the switch portion by the inserted mating connector.

2. The coaxial connector according to claim 1, wherein the fixed leg extends into the opening of the C-shaped clip.

3. The coaxial connector according to claim 1, wherein the switching direction is parallel to the insertion direction.

4. The coaxial connector according to claim 1, wherein the contact element further comprises a switch portion, wherein the switching leg exerts a contact force upon the switch portion while the fixed leg exerts a support force upon the support portion, and that the contact force and the support force are aligned with each other.

5. The coaxial connector according to claim 1, wherein the contact element comprises a back portion connecting the support portion and the switch portion, the back portion extending substantially parallel to the contact force.

6. The coaxial connector according to claim 1, wherein said contact spring is electrically connected to a spring terminal that is situated accessibly from the outside of the coaxial connector.

7. The coaxial connector according to 1, wherein said coaxial connector comprises a housing with an insertion opening.

8. The coaxial connector according to claim 1, wherein the housing forms a mating connector reception, in which the mating connector is connected upon insertion, and that the contact spring comprises a spring bend from which the switching leg and the fixed leg extend through the mating connector insertion axis.

9. The coaxial connector according to claim 1, wherein the contact element is integrally formed as a single body.

10. The coaxial connector according to claim 1, wherein the contact element comprises a terminal portion that is situated accessibly from the outside of the coaxial connector.

11. The coaxial connector according to claim 1, wherein the contact element is formed from stamped sheet metal, both ends bend to approximately 90° to a C-shaped form.

12. The coaxial connector according to claim 1, wherein the coaxial connector has a substantially plane mounting base, adapted to be put on a printed circuit board, the spring terminal and the element terminal being arranged on the mounting base.

13. The coaxial connector according to claim 1, wherein in a view perpendicular to the insertion direction, the housing is of substantially polygonal shape having at least one diagonal, the contact spring extending along the diagonal.

14. The coaxial connector according to claim 1, wherein the coaxial connector comprises an outline that is adapted to lie within a predetermined outline assigned to the coaxial connector on the printed circuit board, and that the coaxial connector further provides recesses in the outline, said recesses extend through the coaxial connector from a mating face of the coaxial connector parallel to the insertion direction up to a mounting base.

15. The coaxial connector according to claim 1, wherein the coaxial connector comprises an electrically conductive ground conductor that at least partially surrounds the insertion opening and embraces the housing.

16. The coaxial connector according to claim 15, wherein the ground conductor comprises at least one face that substantially extends parallel to the insertion direction, said face providing at least one recess designed for holding at least one locking element of the mating connector.

* * * * *

UNITED STATES PATENT AND TRADEMARK OFFICE

CERTIFICATE OF CORRECTION

PATENT NO. : 8,011,939 B2
APPLICATION NO. : 12/736080
DATED : September 6, 2011
INVENTOR(S) : Yves Braem et al.

It is certified that error appears in the above-identified patent and that said Letters Patent is hereby corrected as shown below:

Title Page, item (75);

Please correct the second inventor's last name from "Decrock" to --DeCrock--.

Please correct the spelling third inventor's middle name from "Mariunus" to --Marinus--.

Signed and Sealed this
Twenty-second Day of November, 2011

David J. Kappos

David J. Kappos
*Director of the United States Patent and Trademark Office*